US007071253B2

(12) United States Patent
Voorheis et al.

(10) Patent No.: US 7,071,253 B2
(45) Date of Patent: Jul. 4, 2006

(54) GOLF BALL CORE COMPOSITIONS COMPRISING UNSATURATED LONG CHAIN ORGANIC ACIDS AND THEIR SALTS

(75) Inventors: Peter R Voorheis, Fall River, MA (US); Murali Rajagopalan, South Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 39 days.

(21) Appl. No.: 10/854,538

(22) Filed: May 26, 2004

(65) Prior Publication Data

US 2004/0225064 A1 Nov. 11, 2004

Related U.S. Application Data

(63) Continuation of application No. 10/237,954, filed on Sep. 9, 2002, now Pat. No. 6,762,247, which is a continuation-in-part of application No. 09/951,963, filed on Sep. 13, 2001, now Pat. No. 6,635,716.

(51) Int. Cl.
*A63B 37/02* (2006.01)
*A63B 37/12* (2006.01)

(52) U.S. Cl. ..... 524/322; 524/394; 524/399; 525/261; 525/274; 473/372; 473/373; 473/377

(58) Field of Classification Search ..... None
See application file for complete search history.

(56) References Cited

U.S. PATENT DOCUMENTS

| | | | | |
|---|---|---|---|---|
| 4,844,471 | A | 7/1989 | Terence et al. | 473/372 |
| 4,852,884 | A | 8/1989 | Sullivan | 473/372 |
| 5,252,652 | A | 10/1993 | Egashira et al. | 524/392 |
| 5,605,968 | A | 2/1997 | Egashira et al. | 525/221 |
| 5,697,652 | A | 12/1997 | Nishikawa | |
| 5,697,856 | A | 12/1997 | Moriyama et al. | 473/374 |
| 5,711,723 | A | 1/1998 | Hiraoka et al. | 473/374 |
| 5,776,012 | A | 7/1998 | Moriyama et al. | 473/372 |
| 5,779,563 | A | 7/1998 | Yamagishi et al. | 473/371 |
| 5,816,944 | A | 10/1998 | Asakura et al. | 473/372 |
| 5,872,185 | A | 2/1999 | Ichikawa et al. | 525/93 |
| 5,877,264 | A | 3/1999 | Logothetis et al. | 526/86 |
| 5,919,101 | A | 7/1999 | Yokota et al. | 473/374 |
| 5,929,171 | A | 7/1999 | Sano et al. | 525/261 |
| 5,977,264 | A | 11/1999 | Ichikawa et al. | 525/329.9 |
| 5,994,472 | A | 11/1999 | Egashira et al. | 525/221 |
| 6,120,392 | A | 9/2000 | Kashiwagi et al. | 473/374 |
| 6,121,357 | A | 9/2000 | Yokota | 524/406 |
| 6,126,558 | A | 10/2000 | Higuchi et al. | 473/374 |
| 6,129,640 | A | 10/2000 | Higuchi et al. | 473/374 |
| 6,135,898 | A | 10/2000 | Higuchi et al. | 473/374 |
| 6,174,247 | B1 | 1/2001 | Higuchi et al. | 473/374 |
| 6,184,301 | B1 | 2/2001 | Shindo et al. | 525/261 |
| 6,210,292 | B1 | 4/2001 | Higuchi et al. | 473/374 |
| 6,213,896 | B1 | 4/2001 | Higuchi et al. | 473/374 |
| 6,231,460 | B1 | 5/2001 | Higuchi et al. | 473/374 |
| 6,241,625 | B1 | 6/2001 | Yokota et al. | 473/373 |
| 6,244,978 | B1 | 6/2001 | Higuchi et al. | 473/374 |
| 6,248,028 | B1 | 6/2001 | Higuchi et al. | 473/374 |
| 6,267,692 | B1 | 7/2001 | Higuchi et al. | 473/365 |
| 6,267,694 | B1 | 7/2001 | Higuchi et al. | 473/374 |
| 6,287,218 | B1 | 9/2001 | Ohama | 473/377 |
| 6,299,551 | B1 | 10/2001 | Higuchi et al. | 473/374 |
| 6,575,849 | B1 | 6/2003 | Hayashi et al. | 473/377 |
| 6,653,382 | B1 * | 11/2003 | Statz et al. | 524/400 |
| 6,852,784 | B1 * | 2/2005 | Sullivan | 524/322 |
| 2001/0011045 | A1 | 8/2001 | Takemura et al. | 473/371 |
| 2001/0016522 | A1 | 8/2001 | Watanabe et al. | 473/371 |
| 2001/0018374 | A1 | 8/2001 | Ichikawa et al. | 473/367 |
| 2001/0019971 | A1 | 9/2001 | Hayashi et al. | 473/371 |
| 2001/0031669 | A1 | 10/2001 | Ohama | 473/371 |
| 2001/0031673 | A1 | 10/2001 | Watanabe | 473/378 |
| 2002/0025862 | A1 | 2/2002 | Sullivan et al. | 473/374 |
| 2002/0091188 | A1 | 7/2002 | Statz et al. | 524/400 |
| 2003/0207999 | A1 | 11/2003 | Higuchi et al. | 525/274 |

FOREIGN PATENT DOCUMENTS

| | | |
|---|---|---|
| WO | WO 00/23519 | 4/2000 |
| WO | WO 00/29129 | 5/2000 |

OTHER PUBLICATIONS

Thain, Science and Golf IV, p. 319-327; Jul. 2002.*

* cited by examiner

*Primary Examiner*—David J. Buttner
(74) *Attorney, Agent, or Firm*—William B. Lacy

(57) ABSTRACT

A golf ball comprising a core formed from a polymer composition including a blend of a diene rubber, a halogenated organosulfur compound, and a salt of a mono- or poly-unsaturated long chain organic acid; and a cover having a thickness of about 0.05 inches or less and including a polymer containing an acid group fully-neutralized by a salt of an organic acid, a cation source, or a suitable base of the organic acid.

22 Claims, No Drawings

GOLF BALL CORE COMPOSITIONS COMPRISING UNSATURATED LONG CHAIN ORGANIC ACIDS AND THEIR SALTS

CROSS-REFERENCE TO RELATED APPLICATIONS

This application is a continuation of U.S. patent application Ser. No. 10/237,954, filed Sep. 9, 2002, now U.S. Pat. No. 6,762,247, which is a continuation-in-part of U.S. patent application Ser. No. 09/951,963, filed Sep. 13, 2001, now U.S. Pat. No. 6,635,716.

FIELD OF THE INVENTION

This invention relates generally to golf balls and, in particular, golf ball cores formed of a polymer composition including at least one mono or poly unsaturated long chain organic acid and/or its salt.

BACKGROUND

Golf balls can generally be divided into two classes: solid and wound. Solid golf balls include one-piece, two-piece (i.e., solid core and a cover), and multi-layer (i.e., solid core of one or more layers and/or a cover of one or more layers) golf balls. Wound golf balls typically include a solid, hollow, or fluid-filled center, surrounded by tensioned elastomeric material, and a cover. Solid balls have traditionally been considered longer and more durable than wound balls, but also lack the particular "feel" that is provided by the wound construction and typically preferred by accomplished golfers.

By altering ball construction and composition, however, manufacturers can vary a wide range of playing characteristics, such as resilience, durability, spin, and "feel," each of which can be optimized for various playing abilities, allowing solid golf balls to provide feel characteristics more like their wound predecessors. The golf ball components, in particular, that many manufacturers continually look to improve are the center or core, intermediate layers, if present, and covers.

The core is the "engine" of the golf ball when hit with a club head. Generally, golf ball cores and/or centers are constructed with a polybutadiene-based polymer composition. Compositions of this type are constantly being altered in an effort to provide a targeted or desired coefficient of restitution ("COR") while at the same time resulting in a lower compression which, in turn, can lower the golf ball spin rate, provide better "feel," or both. This is a difficult task, however, given the physical limitations of currently-available polymers. As such, there remains a need for novel and improved golf ball core compositions.

Manufacturers also address the properties and construction of golf ball intermediate and cover layers. These layers have conventionally been formed of ionomer materials and ionomer blends of varying hardness and flexural moduli. This hardness range is still limited and even the softest blends suffer from a "plastic" feel according to some golfers. Recently, however, polyurethane-based materials have been employed in golf ball layers and, in particular, outer cover layers, due to their softer "feel" characteristics without loss in resiliency and/or durability.

There remains a need, however, for improved golf ball center, core, layer, cover, and coating materials and/or blends having further reduced or modified hardness and modulus while maintaining acceptable resilience and superior abrasion resistance and feel. The present invention is directed to golf balls having components, in particular centers and cores, formed of at least one unsaturated long chain organic acid and its salt. Optionally, the said core composition may include halogenated organosulfur compound, or its salt with the at least one unsaturated long chain organic acid.

SUMMARY OF THE INVENTION

The present invention is directed to a golf ball comprising a core and a cover, wherein the core is formed from a polymer composition comprising a mono- or poly-unsaturated long chain organic acid or a salt thereof.

The mono-unsaturated long chain organic acid is described by the formula:

$$R—(CHR')_x—CH=CH—(CH_2)_y—COOH;$$

wherein x and y are integers between 1 and 50; and R and R' are H, unsubstituted and substituted alkyls, aryls, alkenyls, esters, ethers, and acids. Preferably, x and y are integers between 1 and 10.

The salt of a mono-unsaturated long chain organic acid is described by the formula:

$$R—(CHR')_x—CH=CH—(CH_2)_y—COO—M^{+v};$$

wherein x and y are integers between 1 and 50; and R and R' are H, unsubstituted and substituted alkyls, aryls, alkenyls, esters, ethers, and acids; and $M^{+v}$ is a monovalent, divalent or trivalent metal ion. Preferably, x and y are integers between 1 and 10 and $M^{+v}$ is a divalent metal ion.

The poly-unsaturated long chain organic acid is described by the formula:

$$R—(CHR')_x—(CH=CH)_z—(CH_2)_z—(CH=CH)_z—(CH_2)_y—COOH;$$

wherein x and y are integers between 1 and 50; z is an integer between 1 and 10; and R and R' are H and unsubstituted and substituted alkyls, aryls, alkenyls, esters, ethers, acids, and halogens. Preferably, x and y are integers between 1 and 10 and z is an integer between 1 and 5.

The salt of a poly-unsaturated long chain organic acid is described by the formula:

$$R—(CHR')_x—(CH=CH)_z—(CH_2)_z—(CH=CH)_z—(CH_2)_y—COO—M^{+v};$$

wherein x and y are integers between 1 and 50; z is an integer between 1 and 10; and $M^{+v}$ is a monovalent, divalent or trivalent metal ion. Preferably, x and y are integers between 1 and 10 and z is an integer between 1 and 5.

The mono- or poly-unsaturated long chain organic acids may include oleic acid, linoleic acid, linolenic, and their zinc, magnesium, calcium, aluminum, or sodium salts. Preferably, the long chain organic acid is zinc oleate. The composition may additionally include at least one mono- or poly-unsaturated polyorganic acid, or a salt thereof, preferably in an amount of about 1 to about 25 parts per hundred. Ideally, the at least one mono- or poly-unsaturated polyorganic acid, or a salt thereof, is present in an amount of about 2 to about 15 parts per hundred.

In one embodiment, the composition further comprises an organosulfur compound or a salt thereof, preferably a halogenated organosulfur compound, preferably zinc pentachlorothiophenol or the salt thereof.

The core of the golf ball has a diameter of at least about 1.50 inches and may include a polybutadiene rubber composition comprising a halogenated organosulfur compound in any amount, preferably at least about 2.2 parts per hundred. The cover has a thickness of less than about 0.1 inches and comprises a polyurethane composition.

The ball can be of any construction, however, in one embodiment, the core comprises a center and an outer core layer. The center can be solid, or hollow, fluid-filled, or gel-filled. In one preferred embodiment, the core has a diameter of at least about 1.55 inches. Additionally, the cover may be formed of an inner cover layer and an outer cover layer, at least one of which has a thickness of less than about 0.05 inches. If present, the inner cover layer may include an ionomeric material, vinyl resins, polyolefins, polyurethanes, polyureas, polyamides, acrylic resins, thermoplastics, polyphenylene oxide resins, thermoplastic polyesters, thermoplastic rubbers, fully-neutralized polymers, partially-neutralized polymers, and mixtures thereof.

The core further may also include a polybutadiene rubber composition comprising between about 2.2 parts and about 5 parts of a halogenated organosulfur compound, preferably pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; and their zinc salts, the metal salts thereof, and mixtures thereof. The ideal halogenated organosulfur compound is pentachlorothiophenol or the metal salt thereof, typically zinc (preferred), calcium, magnesium, barium, sodium, and lithium.

The core compression should be less than about 75 and the golf ball should have a coefficient of restitution of greater than about 0.800. In another embodiment, the core has a compression less than about 75 and the golf ball has a coefficient of restitution of greater than about 0.815. In still another embodiment, the core has a compression less than about 55 and the golf ball has a coefficient of restitution of greater than about 0.800. The core may also include a polybutadiene rubber composition comprising an $\alpha,\beta$-unsaturated carboxylic acid or a metal salt thereof, an organic peroxide, and at least one density-adjusting filler.

The cover of the golf ball may include a polyurethane composition comprising a prepolymer formed of a polyisocyanate and a polyol, and a curing agent. In a preferred embodiment, at least one of the prepolymer and curing agent are fully saturated. Additionally, the polyurethane composition may include at least one of a UV absorber, a hindered amine light stabilizer, or an optical brightener or at least one density adjusting filler. The cover may also be formed form a polyurea composition comprising a prepolymer formed of a polyisocyanate and a diamine, and a curing agent, at least one of which may be fully saturated. Additionally, the polyurea composition may include at least one of a UV absorber, a hindered amine light stabilizer, or an optical brightener or density-modifying filler.

In one embodiment, the cover is formed of a thermoplastic material, typically selected from ionomeric materials, vinyl resins, polyolefins, polyurethanes, polyureas, polyamides, acrylic resins, thermoplastics, polyphenylene oxide resins, thermoplastic polyesters, thermoplastic rubbers, fully-neutralized polymers, partially-neutralized polymers, thermoplastic elastomers, and mixtures thereof. Additionally, the cover comprises a density-adjusting filler.

The present invention is also directed to a one-piece golf ball is formed from a composition comprising a mono or polyunsaturated long chain organic acid or salt thereof.

The present invention is further directed to a golf ball comprising a core formed from a polymer composition comprising a blend of a diene rubber, a halogenated organosulfur compound, and a salt of a mono- or poly-unsaturated long chain organic acid; and a cover having a thickness of about 0.05 inches or less and comprising a polymer containing an acid group fully-neutralized by a salt of an organic acid, a cation source, or a suitable base of the organic acid.

The mono-unsaturated long chain organic acid is typically described by the formula:

$$R—(CHR')_x—CH{=}CH—(CH_2)_y—COOH;$$

where x and y are integers between 1 and 50; and R and R' are H, un-substituted and substituted alkyls, aryls, alkenyls, esters, ethers, and acids. Preferably, x and y are integers between 1 and 10.

The salt of a mono-unsaturated long chain organic acid is typically described by the general formula:

$$R—(CHR')_x—CH{=}CH—(CH_2)_y—COO—M^{+\nu};$$

where x and y are integers between 1 and 50; and R and R' are H, unsubstituted and substituted alkyls, aryls, alkenyls, esters, ethers, and acids; and $M^{+\nu}$ is a monovalent, divalent or trivalent metal ion. Preferably, x and y are integers between 1 and 10 and $M^{+\nu}$ is a divalent metal ion.

The poly-unsaturated long chain organic acid is typically described by the formula:

$$R—(CHR')_x—(CH{=}CH)_z—(CH_2)_z—(CH{=}CH)_z—(CH_2)_y—COOH;$$

where x and y are integers between 1 and 50; z is an integer between 1 and 10; and R and R' are H and un-substituted and substituted alkyls, aryls, alkenyls, esters, ethers, acids, and halogens. Preferably, x and y are integers between 1 and 10 and z is an integer between 1 and 5.

The salt of a poly-unsaturated long chain organic acid is typically described by the general formula:

$$R—(CHR')_x—(CH{=}CH)_z—(CH_2)_z—(CH{=}CH)_z—(CH_2)_y—COO^{-}M^{+\nu};$$

wherein x and y are integers between 1 and 50; z is an integer between 1 and 10; and $M^{+\nu}$ is a monovalent, divalent or trivalent metal ion. Preferably, x and y are integers between 1 and 10 and z is an integer between 1 and 5.

In one embodiment, the mono- or poly-unsaturated long chain organic acid comprises oleic acid, linoleic acid, linolenic, and their zinc, magnesium, calcium, aluminum, or sodium salts. Preferably, the long chain organic acid is zinc oleate. The salt of a mono- or poly-unsaturated polyorganic acid should be present in an amount of about 1 to about 25 parts per hundred and the salt of a mono- or poly-unsaturated polyorganic acid should be present in an amount of about 2 to about 15 parts per hundred.

The cover may be formed from polyurethanes, polyureas, polyurea-urethanes, polyurethane-ureas, ionomeric materials, vinyl resins, polyolefins, polyamides, acrylic resins, thermoplastics, polyphenylene oxide resins, thermoplastic polyesters, thermoplastic rubbers, or partially-neutralized polymers.

The core preferably has a diameter of about 1.50 inches or greater, more preferably about 1.55 inches or greater. The core may include a center and an outer core layer, the center being hollow or fluid filled or gel filled. In a preferred embodiment, the cover includes an inner cover layer and an outer cover layer, the inner cover having a thickness of about 0.05 inches or less. The inner cover layer can be formed from an ionomeric material, vinyl resins, polyolefins, polyurethanes, polyureas, polyamides, acrylic resins, thermoplastics, polyphenylene oxide resins, thermoplastic polyesters, thermoplastic rubbers, fully-neutralized polymers, or partially-neutralized polymers.

The halogenated organosulfur compound is selected from the group consisting of pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; or the metal salts thereof. Preferably, the halogenated organosulfur compound is pentachlorothiophenol or the metal salt thereof. The metal salt is selected from the group consisting of zinc, calcium, magnesium, barium, sodium, and lithium.

The core has a compression of about 75 or less and the golf ball has a coefficient of restitution of about 0.800 or greater, preferably about 0.815 or greater. In a preferred embodiment, the core has a compression about 55 or less and the golf ball has a coefficient of restitution of about 0.800 or greater. The diene rubber can include an α,β-unsaturated carboxylic acid or a metal salt thereof, an organic peroxide, and at least one density adjusting filler. The polymer composition can also include at least one of a UV absorber, a hindered amine light stabilizer, or an optical brightener or at least one density adjusting filler.

DETAILED DESCRIPTION OF THE INVENTION

The golf ball cores of the present invention may comprise any of a variety of constructions but preferably includes a core and a cover surrounding the core. The core and/or the cover may have more than one layer and an intermediate layer may be disposed between the core and the cover of the golf ball. For example, the core of the golf ball may comprise a conventional center surrounded by an intermediate or outer core layer disposed between the center and the inner cover layer. The core may be a single layer or may comprise a plurality of layers. The innermost portion of the core may be solid or it may be a liquid filled sphere, but preferably it is solid. As with the core, the intermediate layer or outer core layer may also comprise a plurality of layers. The core may also comprise a solid or liquid filled center around which many yards of a tensioned elastomeric material are wound.

The materials for solid cores include compositions having a base rubber, a crosslinking agent, a filler, mono or poly unsaturated long chain organic acid, a co-crosslinking or initiator agent and optionally a halogenated organosulfur compound. The base rubber typically includes natural or synthetic rubbers. A preferred base rubber is 1,4-polybutadiene having a cis-structure of at least 40%, more preferably at least about 90%, and most preferably at least about 95%. Most preferably, the base rubber comprises high-Mooney-viscosity rubber. Preferably, the base rubber has a Mooney viscosity greater than about 35, more preferably greater than about 50. Preferably, the polybutadiene rubber has a molecular weight greater than about 400,000 and a polydispersity of no greater than about 2. Examples of desirable polybutadiene rubbers include BUNA® CB22 and BUNA® CB23, commercially available from Bayer of Akron, Ohio; UBEPOL® 360L and UBEPOL® 150L, commercially available from UBE Industries of Tokyo, Japan; and CARIFLEX® BCP820 and CARIFLEX® BCP824, commercially available from Shell of Houston, Tex. If desired, the polybutadiene can also be mixed with other elastomers known in the art such as natural rubber, polyisoprene rubber and/or styrene-butadiene rubber in order to modify the properties of the core.

The crosslinking agent includes a metal salt, such as a zinc salt or a magnesium unsaturated fatty acid, such as acrylic or methacrylic acid, having 3 to 8 carbon atoms. Examples include, but are not limited to, one or more metal salt diacrylates, dimethacrylates, and monomethacrylates, wherein the metal is magnesium, calcium, zinc, aluminum, sodium, lithium, or nickel. Preferred acrylates include zinc acrylate, zinc diacrylate, zinc methacrylate, zinc dimethacrylate, and mixtures thereof. The crosslinking agent is typically present in an amount greater than about 10 parts per hundred ("pph") parts of the base polymer, preferably from about 20 to 40 pph of the base polymer, more preferably from about 25 to 35 pph of the base polymer.

The initiator agent can be any known polymerization initiator which decomposes during the cure cycle. Suitable initiators include organic peroxide compounds, such as dicumyl peroxide; 1,1-di(t-butylperoxy) 3,3,5-trimethyl cyclohexane; α,α-bis (t-butylperoxy) diisopropylbenzene; 2,5-dimethyl-2,5 di(t-butylperoxy) hexane; di-t-butyl peroxide; and mixtures thereof. Other examples include, but are not limited to, VAROX® 231XL and VAROX® DCP-R, commercially available from Elf Atochem of Philadelphia, Pa.; PERKODOX® BC and PERKODOX® 14, commercially available from Akzo Nobel of Chicago, Ill.; and ELASTOCHEM® DCP-70, commercially available from Rhein Chemie of Trenton, N.J.

It is well known that peroxides are available in a variety of forms having different activity. The activity is typically defined by the "active oxygen content." For example, PERKODOX® BC peroxide is 98% active and has an active oxygen content of 5.80%, whereas PERKODOX® DCP-70 is 70% active and has an active oxygen content of 4.18%. If the peroxide is present in pure form, it is preferably present in an amount of at least about 0.25 pph, more preferably between about 0.35 pph and about 2.5 pph, and most preferably between about 0.5 pph and about 2 pph. Peroxides are also available in concentrate form, which are well-known to have differing activities, as described above. In this case, if concentrate peroxides are employed in the present invention, one skilled in the art would know that the concentrations suitable for pure peroxides are easily adjusted for concentrate peroxides by dividing by the activity. For example, 2 pph of a pure peroxide is equivalent 4 pph of a concentrate peroxide that is 50% active (i.e., 2 divided by 0.5=4).

The halogenated organosulfur compounds of the present invention, if present, include, but are not limited to those having the following general formula:

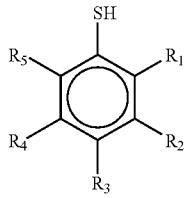

where $R_1$–$R_5$ can be $C_1$–$C_8$ alkyl groups; halogen groups; thiol groups (—SH), carboxylated groups; sulfonated groups; and hydrogen; in any order; and also pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; and their zinc salts. Preferably, the halogenated organosulfur compound is pentachlorothiophenol, which is commercially available in neat form or under the tradename STRUKTOL®, a clay-based carrier containing the sulfur compound pentachlorothiophenol loaded at 45 percent (correlating to 2.4 parts PCTP). STRUKTOL® is commercially available from Struktol Company of America of Stow, Ohio. PCTP is commercially available in neat form from eChinachem of San Francisco, Calif. and in the salt form from eChinachem of San Francisco, Calif. Most preferably, the halogenated organosulfur compound is the zinc salt of pentachlorothiophenol, which is commercially available from eChinachem of San Francisco, Calif. The halogenated organosulfur compounds of the present invention are preferably present in an amount greater than about 2.2 pph, more preferably between about 2.3 pph and about 5 pph, and most preferably between about 2.3 and about 4 pph.

Fillers typically include materials such as tungsten, zinc oxide, barium sulfate, silica, calcium carbonate, zinc carbonate, metals, metal oxides and salts, regrind (recycled core material typically ground to about 30 mesh particle), high-Mooney-viscosity rubber regrind, and the like. Fillers added to one or more portions of the golf ball typically include processing aids or compounds to affect rheological and mixing properties, density-modifying fillers, tear strength, or reinforcement fillers, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents which may be readily selected by one of ordinary skill in the art. Fillers may include polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or at least one additional layer for specialty balls, e.g., a lower weight ball is preferred for a player having a low swing speed.

The invention also includes a method to convert the cis-isomer of the polybutadiene resilient polymer component to the trans-isomer during a molding cycle and to form a golf ball. A variety of methods and materials suitable for cis-to-trans conversion have been disclosed in U.S. Pat. Nos. 6,162,135 and 6,291,592, and U.S. application Ser. No. 09/461,736, filed Dec. 16, 1999 and Ser. No. 09/461,421, filed Dec. 16, 1999, the disclosures of which are incorporated herein, in their entirety, by reference.

The materials used in forming either the golf ball center or any portion of the core, in accordance with the invention, may be combined to form a mixture by any type of mixing known to one of ordinary skill in the art. Suitable types of mixing include single pass and multi-pass mixing. Suitable mixing equipment is well known to those of ordinary skill in the art, and such equipment may include a Banbury mixer, a two-roll mill, or a twin screw extruder.

Conventional mixing speeds for combining polymers are typically used. The mixing temperature depends upon the type of polymer components, and more importantly, on the type of free-radical initiator. Suitable mixing speeds and temperatures are well-known to those of ordinary skill in the art, or may be readily determined without undue experimentation.

The mixture can be subjected to, e.g., a compression or injection molding process, to obtain solid spheres for the center or hemispherical shells for forming an intermediate layer. The temperature and duration of the molding cycle are selected based upon reactivity of the mixture. The molding cycle may have a single step of molding the mixture at a single temperature for a fixed time duration. The molding cycle may also include a two-step process, in which the polymer mixture is held in the mold at an initial temperature for an initial duration of time, followed by holding at a second, typically higher temperature for a second duration of time. In a preferred embodiment of the current invention, a single-step cure cycle is employed. The materials used in forming either the golf ball center or any portion of the core, in accordance with the invention, may be combined to form a golf ball by an injection molding process, which is also well-known to one of ordinary skill in the art. Although the curing time depends on the various materials selected, those of ordinary skill in the art will be readily able to adjust the curing time upward or downward based on the particular materials used and the discussion herein.

Properties that are desirable for the cover include good moldability, high abrasion resistance, high tear strength, high resilience, and good mold release. The cover typically has a thickness to provide sufficient strength, good performance characteristics, and durability. The cover preferably has a thickness of less than about 0.1 inches, more preferably, less than about 0.05 inches, and most preferably, between about 0.02 inches and about 0.04 inches. The invention is particularly directed towards a multilayer golf ball which comprises a core, an inner cover layer, and an outer cover layer. In this embodiment, preferably, at least one of the inner and outer cover layer has a thickness of less than about 0.05 inches, more preferably between about 0.02 inches and about 0.04 inches. Most preferably, the thickness of either layer is about 0.03 inches.

When the golf ball of the present invention includes an inner cover layer, this layer can include any materials known to those of ordinary skill in the art, including thermoplastic and thermosetting material, but preferably the inner cover can include any suitable materials, such as ionic copolymers of ethylene and an unsaturated monocarboxylic acid which are available under the trademark SURLYN® of E.I. DuPont de Nemours & Co., of Wilmington, Del., or IOTEK® or ESCOR® of Exxon. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The mono-unsaturated long chain organic acids of the present invention are described by Formula 1:

$$R—(CHR')_x—CH{=}CH—(CH_2)_y—COOH \qquad \text{Formula 1}$$

wherein x and y are integers between 1 to 50; preferably x and y are integers between 1 to 10; more preferably x and y are 5 to 9 and most preferably x and y are 7. R and R' are H, unsubstituted and substituted and alkyl, aryl, alkenyl, ester, ether, acid, and halogen.

The salts of the mono-unsaturated long chain organic acids of the present invention are described by Formula 2:

$$R—(CHR')_x—CH{=}CH—(CH_2)_y—COO^-M^{+v} \qquad \text{Formula 2}$$

wherein x and y are integers between 1 to 50; preferably x and y are integers between 1 to 10; more preferably x and y are 5 to 9 and most preferably x and y are 7. R and R' are H, un-substituted and substituted and alkyl, aryl, alkenyl, ester, ether, acid, and halogen; $M^{+v}$ is monovalent, divalent or trivalent metal ion; v is an integer between 1 to 3. Preferably $M^{+v}$ is divalent. Depending on the valency of the metal, one or more unsaturated organic acid will be attached to the metal ion.

The poly-unsaturated long chain organic acids of the present invention are described by Formula 3:

$$R—(CHR')_x—(CH{=}CH)_z—(CH_2)_z—(CH{=}CH)_z—(CH_2)_y—COOH \qquad \text{Formula 3}$$

wherein x and y are integers between 1 to 50 and z is an integer between 1 to 10; preferably x and y are integers between 1 to 10 and z is 1 to 5; more preferably x and y are 5 to 9 and z is 1 to 3; and most preferably x and y are 7 and z is 1. R and R' are H, unsubstituted and substituted and alkyl, aryl, alkenyl, ester, ether, acid, and halogen.

The salts of the poly-unsaturated long chain organic acids of the present invention are described by Formula 4:

$$R—(CHR')_x—(CH{=}CH)_z—(CH_2)_z—(CH{=}CH)_z—(CH_2)_y—COO^-M^{+v} \qquad \text{Formula 4}$$

wherein x and y are integers between 1 to 50 and z is an integer between 1 to 10; preferably x and y integers between 1 to 10 and z is 1 to 5; more preferably x and y are 5 to 9 and z is 1 to 3 and most preferably x and y are 7 and z is 1. R and R' are H, unsubstituted and substituted and alkyl, aryl, alkenyl, ester, ether, acid, and halogen. $M^{+v}$ is monovalent, divalent or trivalent metal ion; z is an integer between 1 to 3. Preferably $M^{+v}$ is divalent.

Examples include but not limited to the unsaturated long chain organic acids or their salts are oleic acid, linoleic acid, linolenic, behenic acid and their salts based on zinc, magnesium, calcium aluminum, sodium etc.

The core composition of the present invention comprises at least about 1 to 25 parts per hundred of the at least one long chain unsaturated organic acid or its salts as shown in Formula 1 thru 4.

Table I below summarizes a partial list of both saturated and unsaturated organic acids:

TABLE I

| Number of Carbons | Trivial Name | Systematic Name | Number Double Bonds | Melting Point (° C.) |
|---|---|---|---|---|
| 4 | Butyric | Butanoic | 0 | −8 |
| 6 | Caproic | Hexanoic | 0 | 13.4 |
| 8 | Caprylic | Octanoic | 0 | 16.7 |
| 10 | Capric | Decanoic | 0 | 31.6 |
| 12 | Lauric | Dodecanoic | 0 | 44.2 |
| 14 | Myristic | Tetradecanoic | 0 | 54.4 |
| 16 | Palmitic | Hexadecanoic | 0 | 62.9 |
| 18 | Stearic | Octadecanoic | 0 | 69.6 |
| 18 | Oleic | Octadecenoic | 1 | 14 |
| 18 | Linoleic | Octadecadienoic | 2 | −5 |
| 18 | Linolenic | Octadecatrienoic | 3 | −11 |
| 20 | Arachidic | Eicosanoic | 0 | 75 |
| 20 | Arachidonic | Eicosatetraenoic | 4 | −50 |
| 22 | Behenic | Docosamoic | 0 | 80 |
| 24 | Lignoceric | Tetracosanoic | 0 | 84.2 |

In another emobodiment of the present invention, the molecular weight of the said unsaturated long chain organic acid or its salt is at least 200 and preferably 250 to 600 and more preferably 280 to 523 and most preferably 280 to 290.

The present invention is also directed to the use of the above organic unsaturated acid or its salt along with at least one halogenated organosulfur compound in the core formulation. In another embodiemnt, the present invention of the mono and poly unsaturated long chain organic acid or its salts can be used in combination with the saturated organic acid or its salts like stearic acid or zinc or magnesium stearate etc.

This golf ball can likewise include one or more homopolymeric or copolymeric inner cover materials, such as:

(1) Vinyl resins, such as those formed by the polymerization of vinyl chloride, or by the copolymerization of vinyl chloride with vinyl acetate, acrylic esters or vinylidene chloride;

(2) Polyolefins, such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using a single-site catalyst or a metallocene catalyst;

(3) Polyurethanes, such as those prepared from polyols and diisocyanates or polyisocyanates, such as those disclosed in U.S. Pat. No. 5,334,673.

(4) Polyureas, such as those disclosed in U.S. Pat. No. 5,484,870.

(5) Polyamides, such as poly(hexamethylene adipamide) and others prepared from diamines and dibasic acids, as well as those from amino acids such as poly(caprolactam), and blends of polyamides with SURLYN®, polyethylene, ethylene copolymers, ethyl-propylene-non-conjugated diene terpolymer, and the like;

(6) Acrylic resins and blends of these resins with poly vinyl chloride, elastomers, and the like;

(7) Thermoplastics, such as urethanes; olefinic thermoplastic rubbers, such as blends of polyolefins with ethylene-propylene-non-conjugated diene terpolymer; block copolymers of styrene and butadiene, isoprene or ethylene-butylene rubber; or copoly(ether-amide), such as PEBAX®, sold by ELF Atochem of Philadelphia, Pa.;

(8) Polyphenylene oxide resins or blends of polyphenylene oxide with high impact polystyrene as sold under the trademark NORYL® by General Electric Company of Pittsfield, Mass.;

(9) Thermoplastic polyesters, such as polyethylene terephthalate, polybutylene terephthalate, polyethylene terephthalate/glycol modified and elastomers sold under the trademarks HYTREL® by E.I. DuPont de Nemours & Co. of Wilmington, Del., and LOMOD® by General Electric Company of Pittsfield, Mass.;

(10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and

(11) Blends of thermoplastic rubbers with polyethylene, propylene, polyacetal, nylon, polyesters, cellulose esters, and the like.

Preferably, the inner cover includes polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers, and blends thereof. Suitable cover compositions also include a polyether or polyester thermoplastic urethane, a thermoset polyurethane, a low modulus ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. Preferably, the acrylic or methacrylic acid is present in about 8 to 35 weight percent, more preferably 8 to 25 weight percent, and most preferably 8 to 20 weight percent. The skilled artisan can selectively choose the appropriate inner cover materials for the golf ball outer cover application.

Any of the inner or outer cover layers may also be formed from polymers containing $\alpha,\beta$-unsaturated carboxylic acid groups, or the salts thereof, that have been 100 percent neutralized by organic fatty acids. The acid moieties of the highly-neutralized polymers ("HNP"), typically ethylene-based ionomers, are preferably neutralized greater than about 70%, more preferably greater than about 90%, and most preferably at least about 100%. The HNP's can be also be blended with a second polymer component, which, if containing an acid group, may be neutralized in a conventional manner, by the organic fatty acids of the present invention, or both. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like.

The acid copolymers can be described as E/X/Y copolymers where E is ethylene, X is an $\alpha,\beta$-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer.

The organic acids are aliphatic, mono-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, bebenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending).

Thermoplastic polymer components, such as copolyetheresters, copolyesteresters, copolyetheramides, elastomeric polyolefins, styrene diene block copolymers and their hydrogenated derivatives, copolyesteramides, thermoplastic polyurethanes, such as copolyetherurethanes, copolyesterurethanes, copolyureaurethanes, epoxy-based polyurethanes, polycaprolactone-based polyurethanes, polyureas, and polycarbonate-based polyurethanes fillers, and other ingredients, if included, can be blended in either before, during, or after the acid moieties are neutralized, thermoplastic polyurethanes.

Examples of these materials are disclosed in U.S. patent application Publication Nos. 2001/0018375 and 2001/0019971, which are incorporated herein in their entirety by express reference thereto.

While the outer cover may be formed of any of the above-listed materials, the outer cover preferably includes a polyurethane, polyurea, or epoxy composition, generally comprising the reaction product of at least one polyisocyanate, polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"); polymeric MDI; carbodiimide-modified liquid MDI; 4,4'-dicyclohexylmethane diisocyanate ("$H_{12}$MDI"); p-phenylene diisocyanate ("PPDI"); m-phenylene diisocyanate ("MPDI"); toluene diisocyanate ("TDI"); 3,3'-dimethyl-4,4'-biphenylene diisocyanate ("TODI"); isophoroneduisocyanate ("IPDI"); hexamethylene diisocyanate ("HDI"); naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"); tetracene diisocyanate; napthalene diisocyanate; anthracene diisocyanate; isocyanurate of toluene diisocyanate; uretdione of hexamethylene diisocyanate; and mixtures thereof. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer groups. Examples of "low free monomer" diisocyanates include, but are not limited to Low Free Monomer MDI, Low Free Monomer TDI, Low Free Monomer HDI, and Low Free Monomer PPDI.

The at least one polyisocyanate should have less than about 14% unreacted NCO groups. Preferably, the at least one polyisocyanate has no greater than about 7.5% NCO, and more preferably, less than about 7.0%.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups.

Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, PTMEG-initiated polycaprolactone, and mixtures thereof. The hydrocarbon chain can have saturated or unsaturated bonds, or substituted or unsubstituted aromatic and cyclic groups.

Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups.

Polyamine curatives are also suitable for use in polyurethane covers. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline) ("MCDEA"); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline) ("MDEA"); 4,4'-methylene-bis-(2,3-dichloroaniline) ("MDCA"); 4,4'-diamino-3,3'-diethyl-5,5'-dimethyl diphenylmethane; 2,2',3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE® 300, commercially available from Albermarle Corporation of Baton Rouge, La. Suitable polyamine curatives include both primary and secondary amines.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy] ethoxy}benzene; 1,4-butanediol; 1,5-pentanediol; 1,6-hexanediol; resorcinol-di-(β-hydroxyethyl) ether; hydroquinone-di-(β-hydroxyethyl) ether; and mixtures thereof. Preferred hydroxy-terminated curatives include 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy] ethoxy}benzene; 1,4-butanediol, and mixtures thereof.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a particularly preferred embodiment of the present invention, saturated polyurethanes used to form cover layers, preferably the outer cover layer, and may be selected from among both castable thermoset and thermoplastic polyurethanes. In this embodiment, the saturated polyurethanes are substantially free of aromatic groups or moieties.

Saturated diisocyanates which can be used include, but are not limited to, ethylene diisocyanate; propylene-1,2-diisocyanate; tetramethylene-1,4-diisocyanate; 1,6-hexamethylene-diisocyanate ("HDI"); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate ("IPDI"); methyl cyclohexylene diisocyanate; triisocyanate of HDI; triisocyanate of 2,2,4-trimethyl-1,6-hexane diisocyanate ("TMDI"). The most preferred saturated diisocyanates are 4,4'-dicyclohexylmethane diisocyanate ("HMDI") and isophorone diisocyanate ("IPDI").

Saturated polyols which are appropriate for use in this invention include, but are not limited to, polyether polyols such as polytetramethylene ether glycol and poly(oxypropylene) glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol initiated polycaprolactone, 1,4-butanediol initiated polycaprolactone, 1,6-hexanediol initiated polycaprolactone; trimethylol propane initiated polycaprolactone, neopentyl glycol initiated polycaprolactone, PTMEG-initiated polycaprolactone. The most preferred saturated polyols are PTMEG and PTMEG-initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine, ethylene diamine, diethylene triamine, triethylene tetramine, tetraethylene pentamine, 4,4'-dicyclohexylmethane diamine, 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino) cyclohexane; 1,4-bis-(sec-butylamino)cyclohexane; isophorone diamine, hexamethylene diamine, propylene diamine, 1-methyl-2,4-cyclohexyl diamine, 1-methyl-2,6-cyclohexyl diamine, 1,3-diaminopropane, dimethylamino propylamine, diethylamino propylamine, imido-bis-propylamine, isomers and mixtures of isomers of diaminocyclohexane, monoethanolamine, diethanolamine, triethanolamine, monoisopropanolamine, and diisopropanolamine. The most preferred saturated curatives are 1,4-butanediol, 1,4-cyclohexyldimethylol and 4,4'-bis-(sec-butylamino)-dicyclohexylmethane.

Suitable catalysts include, but are not limited to bismuth catalyst, oleic acid, triethylenediamine (DABCO®-33LV), di-butyltin dilaurate (DABCO®-T12) and acetic acid. The most preferred catalyst is di-butyltin dilaurate (DABCO®-T12). DABCO® materials are manufactured by Air Products and Chemicals, Inc.

It is well known in the art that if the saturated polyurethane materials are to be blended with other thermoplastics, care must be taken in the formulation process so as to produce an end product which is thermoplastic in nature. Thermoplastic materials may be blended with other thermoplastic materials, but thermosetting materials are difficult if not impossible to blend homogeneously after the thermosetting materials are formed. Preferably, the saturated polyurethane comprises from about 1 to about 100%, more preferably from about 10 to about 75% of the cover composition and/or the intermediate layer composition. About 90 to about 10%, more preferably from about 90 to about 25% of the cover and/or the intermediate layer composition is comprised of one or more other polymers and/or other materials as described below. Such polymers include, but are not limited to polyurethane/polyurea ionomers, polyurethanes or polyureas, epoxy resins, polyethylenes, polyamides and polyesters, polycarbonates and polyacrylin. Unless otherwise stated herein, all percentages are given in percent by weight of the total composition of the golf ball layer in question.

Polyurethane prepolymers are produced by combining at least one polyol, such as a polyether, polycaprolactone, polycarbonate or a polyester, and at least one isocyanate. Thermosetting polyurethanes are obtained by curing at least one polyurethane prepolymer with a curing agent selected from a polyamine, triol or tetraol. Thermoplastic polyurethanes are obtained by curing at least one polyurethane prepolymer with a diol curing agent. The choice of the curatives is critical because some urethane elastomers that are cured with a diol and/or blends of diols do not produce urethane elastomers with the impact resistance required in a golf ball cover. Blending the polyamine curatives with diol cured urethane elastomeric formulations leads to the production of thermoset urethanes with improved impact and cut resistance.

Thermoplastic polyurethanes may be blended with suitable materials to produce a thermoplastic end product. Examples of such additional materials may include ionomers such as the SURLYN®, ESCOR® and IOTEK® copolymers described above.

Other suitable materials which may be combined with the saturated polyurethanes in forming the cover and/or intermediate layer(s)of the golf balls of the invention include ionic or non-ionic polyurethanes and polyureas, epoxy resins, polyethylenes, polyamides and polyesters. For example, the cover and/or intermediate layer may be formed from a blend of at least one saturated polyurethane and thermoplastic or thermoset ionic and non-ionic urethanes and polyurethanes, cationic urethane ionomers and urethane epoxies, ionic and non-ionic polyureas and blends thereof. Examples of suitable urethane ionomers are disclosed in U.S. Pat. No. 5,692,974 entitled "Golf Ball Covers," the disclosure of which is hereby incorporated by reference in its entirety. Other examples of suitable polyurethanes are described in U.S. Pat. No. 5,334,673. Examples of appropriate polyureas are discussed in U.S. Pat. No. 5,484,870 and examples of suitable polyurethanes cured with epoxy group containing curing agents are disclosed in U.S. Pat. No. 5,908,358, the disclosures of which are hereby incorporated herein by reference in their entirety.

A variety of conventional components can be added to the cover compositions of the present invention. These include, but are not limited to, white pigment such as $TiO_2$, ZnO, optical brighteners, surfactants, processing aids, foaming agents, density-controlling fillers, UV stabilizers and light stabilizers. Saturated polyurethanes are resistant to discoloration. However, they are not immune to deterioration in their mechanical properties upon weathering. Addition of UV absorbers and light stabilizers to any of the above compositions and, in particular, the polyurethane compositions, help to maintain the tensile strength, elongation, and color stability. Suitable UV absorbers and light stabilizers include TINUVIN® 328, TINUVIN® 213, TINUVIN® 765, TINUVIN® 770 and TINUVIN® 622. The preferred UV absorber is TINUVIN® 328, and the preferred light stabilizer is TINUVIN® 765. TINUVIN® products are available from Ciba-Geigy. Dyes, as well as optical brighteners and fluorescent pigments may also be included in the golf ball covers produced with polymers formed according to the present invention. Such additional ingredients may be added in any amounts that will achieve their desired purpose.

Any method known to one of ordinary skill in the art may be used to polyurethanes of the present invention. One commonly employed method, known in the art as a one-shot method, involves concurrent mixing of the polyisocyanate, polyol, and curing agent. This method results in a mixture that is inhomogenous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition. Other methods suitable for forming the layers of the present invention include reaction injection molding ("RIM"), liquid injection molding ("LIM"), and pre-reacting the components to form an injection moldable thermoplastic polyurethane and then injection molding, all of which are known to one of ordinary skill in the art.

It has been found by the present invention that the use of a castable, reactive material, which is applied in a fluid form, makes it possible to obtain very thin outer cover layers on golf balls. Specifically, it has been found that castable, reactive liquids, which react to form a urethane elastomer material, provide desirable very thin outer cover layers.

The castable, reactive liquid employed to form the urethane elastomer material can be applied over the core using a variety of application techniques such as spraying, dipping, spin coating, or flow coating methods which are well known in the art. An example of a suitable coating technique is that which is disclosed in U.S. Pat. No. 5,733,428, the disclosure of which is hereby incorporated by reference in its entirety in the present application.

The outer cover is preferably formed around the inner cover by mixing and introducing the material in the mold halves. It is important that the viscosity be measured over time, so that the subsequent steps of filling each mold half, introducing the core into one half and closing the mold can be properly timed for accomplishing centering of the core cover halves fusion and achieving overall uniformity. Suitable viscosity range of the curing urethane mix for introducing cores into the mold halves is determined to be approximately between about 2,000 cP and about 30,000 cP, with the preferred range of about 8,000 cP to about 15,000 cP.

To start the cover formation, mixing of the prepolymer and curative is accomplished in motorized mixer including mixing head by feeding through lines metered amounts of curative and prepolymer. Top preheated mold halves are filled and placed in fixture units using centering pins moving into holes in each mold. At a later time, a bottom mold half or a series of bottom mold halves have similar mixture amounts introduced into the cavity. After the reacting materials have resided in top mold halves for about 40 to about 80 seconds, a core is lowered at a controlled speed into the gelling reacting mixture.

A ball cup holds the ball core through reduced pressure (or partial vacuum). Upon location of the coated core in the halves of the mold after gelling for about 40 to about 80 seconds, the vacuum is released allowing core to be released. The mold halves, with core and solidified cover half thereon, are removed from the centering fixture unit, inverted and mated with other mold halves which, at an appropriate time earlier, have had a selected quantity of reacting polyurethane prepolymer and curing agent introduced therein to commence gelling.

Similarly, U.S. Pat. No. 5,006,297 and U.S. Pat. No. 5,334,673 both also disclose suitable molding techniques which may be utilized to apply the castable reactive liquids employed in the present invention. Further, U.S. Pat. Nos. 6,180,040 and 6,180,722 disclose methods of preparing dual core golf balls. The disclosures of these patents are hereby incorporated by reference in their entirety. However, the method of the invention is not limited to the use of these techniques.

The molding process and composition of golf ball portions typically results in a gradient of material properties. Methods employed in the prior art generally exploit hardness to quantify these gradients. Hardness is a qualitative measure of static modulus and does not represent the modulus of the material at the deformation rates associated with golf ball use, i.e., impact by a club. As is well known to one skilled in the art of polymer science, the time-temperature superposition principle may be used to emulate alternative deformation rates. For golf ball portions including polybutadiene, a 1-Hz oscillation at temperatures between 0° C. and −50° C. are believed to be qualitatively equivalent to golf ball impact rates. Therefore, measurement of loss tangent and dynamic stiffness at 0° C. to −50° C. may be used to accurately anticipate golf ball performance, preferably at temperatures between about −20° C. and −50° C.

The resultant golf balls typically have a coefficient of restitution of greater than about 0.7, preferably greater than about 0.75, more preferably greater than about 0.78; and most preferably greater than about 0.810. The golf balls also typically have an Atti compression of at least about 40, preferably from about 50 to 120, and more preferably from about 60 to 100. The golf ball cured polybutadiene material typically has a hardness of at least about 15 Shore A, preferably between about 30 Shore A and 80 Shore D, more preferably between about 50 Shore A and 60 Shore D.

When golf balls are prepared according to the invention, they typically will have dimple coverage greater than about 60 percent, preferably greater than about 65 percent, and more preferably greater than about 75 percent. The flexural modulus of the cover on the golf balls, as measured by ASTM method D6272-98, Procedure B, is typically greater than about 500 psi, and is preferably from about 500 psi to 150,000 psi. As discussed herein, the outer cover layer is preferably formed from a relatively soft polyurethane material. In particular, the material of the outer cover layer should have a material hardness, as measured by ASTM-D2240, less than about 45 Shore D, preferably less than about 40 Shore D, more preferably between about 25 and about 40 Shore D, and most preferably between about 30 and about 40 Shore D. The casing preferably has a material hardness of less than about 70 Shore D, more preferably between about 30 and about 70 Shore D, and most preferably, between about 50 and about 65 Shore D.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

The core of the present invention has an Atti compression of less than about 80, more preferably, between about 40 and about 80, and most preferably, between about 50 and about 70. In an alternative, low compression embodiment, the core has a compression less than about 20, more preferably less than about 10, and most preferably, 0. The overall outer diameter ("OD") of the core is less than about 1.610 inches, preferably, no greater than 1.590 inches, more preferably between about 1.540 inches and about 1.580 inches, and most preferably between about 1.50 inches to about 1.570 inches. The OD of the casing of the golf balls of the present invention is preferably between 1.580 inches and about 1.640 inches, more preferably between about 1.590 inches to about 1.630 inches, and most preferably between about 1.600 inches to about 1.630 inches.

The present multilayer golf ball can have an overall diameter of any size. Although the United States Golf Association ("USGA") specifications limit the minimum size of a competition golf ball to 1.680 inches. There is no specification as to the maximum diameter. Golf balls of any size, however, can be used for recreational play. The preferred diameter of the present golf balls is from about 1.680 inches to about 1.800 inches. The more preferred diameter is from about 1.680 inches to about 1.760 inches. The most preferred diameter is about 1.680 inches to about 1.740 inches.

EXAMPLES

Three solid cores, each having an outer diameter of 1.58 inches, were formed of a composition comprising polybutadiene rubber, zinc diacrylate, zinc oxide, dicumyl peroxide, barium sulfate, and color dispersion. One core, representative of conventional technology, was used as a control. The two remaining cores were each additionally blended with 5.3 parts Struktol® (Example 1) and the zinc salt of pentachlorothiophenol at 2.4 parts (Example 2). Struktol® at 5.3 parts contains 2.4 parts PCTP. The specific compositions for each of the solid cores are presented below in Table I.

TABLE II

| | CONTROL | | | EXAMPLE 1 | | | EXAMPLE 2 | | | |
|---|---|---|---|---|---|---|---|---|---|---|
| INGREDIENTS | | | | | | | | | | |
| polybutadiene rubber | 100 | 100 | 100 | 100 | 100 | 100 | 100 | 100 | 100 | 100 |
| zinc diacrylate | 18 | 25 | 30 | 27 | 34 | 41 | 20 | 25 | 30 | 35 |
| dicumyl peroxide | 0.5 | 0.5 | 0.5 | 1.8 | 1.8 | 1.8 | 0.8 | 0.8 | 0.8 | 0.8 |
| Struktol ® A95 | — | — | — | 5.3 | 5.3 | 5.3 | — | — | — | — |
| zinc salt of PCTP | — | — | — | — | — | — | 2.4 | 2.4 | 2.4 | 2.4 |
| zinc oxide | 26.5 | 24.1 | 22.2 | 5 | 5 | 5 | 5 | 5 | 5 | 5 |
| barium sulfate | — | — | — | 16.2 | 13.4 | 10.6 | 21.7 | 19.7 | 17.7 | 15.7 |
| color dispersion | 0.14 | 0.14 | 0.14 | 0.14 | 0.14 | 0.14 | 0.14 | 0.14 | 0.14 | 0.14 |

TABLE II-continued

| | CONTROL | | | EXAMPLE 1 | | | EXAMPLE 2 | | | |
|---|---|---|---|---|---|---|---|---|---|---|
| PROPERTY | | | | | | | | | | |
| Effective Modulus (psi) | 3800 | 6200 | 8700 | 4100 | 6200 | 7700 | 3600 | 5100 | 7400 | 9700 |
| Atti Compression | 17 | 52 | 76 | 22 | 52 | 67 | 13 | 38 | 65 | 84 |
| COR @ 125 ft/s | 0.764 | 0.789 | 0.802 | 0.773 | 0.794 | 0.802 | 0.782 | 0.801 | 0.813 | 0.823 |

It is very apparent that the addition of PCTP, in either form, increases COR, decreases compression, or both. In particular, the PCTP zinc salt provides comparable COR's with lower compression and/or increased COR's with comparable (or lower) compression, both of which are desirable golf ball properties.

The said mono and poly unsaturated long chain organic acid or its salt of the present invention is used in the core formulation as shown in Tables III and IV below;

The halogenated organosulfur polymers of the present invention may also be used in golf equipment, in particular, inserts for golf clubs, such as putters, irons, and woods, and in golf shoes and components thereof.

As used herein, the term "about," used in connection with one or more numbers or numerical ranges, should be understood to refer to all such numbers, including all numbers in a range.

TABLE III

The effect of a salt of an unsaturated long chain organic acid in core performance

| | 1 | 2 | 3 | 4 | 5 | 6 | 7 | 8 |
|---|---|---|---|---|---|---|---|---|
| Bayer ® CB-23 | 100 | 100 | 100 | 100 | 100 | 100 | 100 | 100 |
| Zinc Diacrylate | 24.0 | 28.0 | 24.0 | 28.0 | 24.0 | 28.0 | 24.0 | 28.0 |
| Zinc Oxide | 5.0 | 5.0 | 5.0 | 5.0 | 5.0 | 5.0 | 5.0 | 5.0 |
| DCP-70 | 0.60 | 0.60 | 0.60 | 0.60 | 0.60 | 0.60 | 0.60 | 0.60 |
| Barium Sulfate | 20.9 | 19.3 | 20.9 | 19.3 | 20.9 | 19.3 | 20.9 | 19.3 |
| Struktol ® A50* | 0.0 | 0.0 | 1.0 | 1.0 | 3.0 | 3.0 | 5.0 | 5.0 |
| Atti Compression | 46 | 69 | 47 | 67 | 43 | 65 | 42 | 64 |
| COR @ 125 fps | 0.780 | 0.794 | 0.784 | 0.797 | 0.781 | 0.795 | 0.780 | 0.795 |

*a salt derivative of unsaturated long chain organic acid

TABLE IV

The effect of a salt of an unsaturated fatty acid in core performance in the presence of zinc pentachlorothiophenol

| | 9 | 10 | 11 | 12 | 13 | 14 | 15 | 16 |
|---|---|---|---|---|---|---|---|---|
| Bayer ® CB-23 | 100 | 100 | 100 | 100 | 100 | 100 | 100 | 100 |
| Zinc Diacrylate | 24.0 | 28.0 | 24.0 | 28.0 | 24.0 | 28.0 | 24.0 | 28.0 |
| Zinc Oxide | 5.0 | 5.0 | 5.0 | 5.0 | 5.0 | 5.0 | 5.0 | 5.0 |
| Zinc PCTP | 2.35 | 2.35 | 2.35 | 2.35 | 2.35 | 2.35 | 2.35 | 2.35 |
| DCP-70 | 0.80 | 0.80 | 0.80 | 0.80 | 0.80 | 0.80 | 0.80 | 0.80 |
| Barium Sulfate | 20.9 | 19.3 | 20.9 | 19.3 | 20.9 | 19.3 | 20.9 | 19.3 |
| Struktol ® A50* | 0.0 | 0.0 | 1.0 | 1.0 | 3.0 | 3.0 | 5.0 | 5.0 |
| Atti Compression | 25 | 44 | 23 | 47 | 28 | 44 | 25 | 47 |
| CoR @ 125 fps | 0.784 | 0.799 | 0.787 | 0.803 | 0.789 | 0.802 | 0.787 | 0.802 |

*a salt derivative of unsaturated long chain organic acid

As evident from Tables III and IV, the presence of a salt derivative of unsaturated long chain organic acid surprisingly improved the COR value without adversely affecting the compression of the core. Based on the product literature, it appears that Struktol® A-50 from Struktol Company, contains zinc oleate as an unsaturated long chain organic acid salt. Other Commercially available sources include, but are not limited to, Ferro Corporation of Cleveland, Ohio; Patco Additives of Kansas City, MS; Harwick Standard of Akron, Ohio; and Crompton corporation of Greenwich, Conn.

Other than in the operating examples, or unless otherwise expressly specified, all of the numerical ranges, amounts, values and percentages, such as those for amounts of materials and others, in the following portion of the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball comprising:

a core formed from a polymer composition comprising a blend of a diene rubber, a halogenated organosulfur compound, and a salt of a mono- or poly-unsaturated long chain organic acid; and a cover having a thickness of about 0.05 inches or less and comprising a polymer containing an acid group, an organic acid or a salt, and sufficient cation source, or a suitable base of the organic acid, to fully-neutralize the acid groups of the polymer;

wherein the core comprises a center and an outer core layer and has an outer diameter of 1.590 inches to 1.610 inches; and the cover comprises an inner cover layer comprising the fully-neutralized polymer and an outer cover layer comprising polyurea, a polyura-urethane, or a polyurethane-urea.

2. The golf ball of claim 1, wherein the mono-unsaturated long chain organic acid is described by the formula:

$$R—(CHR')_x—CH=CH—(CH_2)_y—COOH;$$

wherein x and y are integers between 1 and 50; and R and R' are H, un-substituted and substituted alkyls, aryls, alkenyls, esters, ethers, or acids.

3. The golf ball of claim 2, wherein x and y are integers between 1 and 10.

4. The golf ball of claim 1, wherein the salt of a mono-unsaturated long chain organic acid is described by the general formula:

$$R—(CHR')_xCH=CH—(CH_2)_y—COO^-M^{+v};$$

wherein x and y are integers between 1 and 50; and R and R' are H, unsubstituted and substituted alkyls, aryls, alkenyls, esters, ethers, or acids; and $M^{+v}$ is a monovalent, divalent or trivalent metal ion.

5. The golf ball of claim 4, wherein x and y are integers between 1 and 10 and $M^{+v}$ is a divalent metal ion.

6. The golf ball of claim 1, wherein the poly-unsaturated long chain organic acid is described by the formula:

$$R—(CHR')_x—(CH=CH)_z—(CH_2)_z—(CH=CH)_z—(CH_2)_y—COOH;$$

wherein x and y are integers between 1 and 50; z is an integer between 1 and 10; and R and R' are H and unsubstituted and substituted alkyls, style, alkenyls, esters, ethers, acids, or halogens.

7. The golf ball of claim 6, wherein x and y are integers between 1 and 10 and z is an integer between 1 and 5.

8. The golf ball of claim 1, wherein the salt of a poly-unsaturated long chain organic acid is described by the general formula:

$$R—(CHR')_x—(CH=CH)_z(CH_2)_z—(CH=CH)_z—(CH_2)_y—COO^-M^{+v};$$

wherein x and y are integers between 1 and 50; z is an integer between 1 and 10; and $M^{+v}$ is a monovalent, divalent or trivalent metal ion.

9. The golf ball of claim 8, wherein x and y are integers between 1 and 10 and z is an integer between 1 and 5.

10. The golf ball of claim 1, wherein the mono- or poly-unsaturated long chain organic acid comprises oleic acid, linoleic acid, linolenic, or their zinc, magnesium, calcium, aluminum, or sodium salts.

11. The golf ball of claim 10, wherein the long chain organic acid is zinc oleate.

12. The golf ball of claim 1, wherein the salt of a mono- or poly-unsaturated organic acid is present in an amount of about 1 to about 25 parts per hundred.

13. The golf ball of claim 11, wherein the salt of a mono- or poly-unsaturated organic acid is present in an amount of about 2 to about 15 parts per hundred.

14. The golf ball of claim 1, wherein the center is hollow or fluid filled or gel filled.

15. The golf ball of claim 1, wherein the halogenated organosulfur compound is selected from the group consisting of pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5.bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; or the metal salts thereof.

16. The golf ball of claim 15, wherein the halogenated organosulfur compound is pentachlorothiophenol or the metal salt thereof.

17. The golf ball of claim 16, wherein the metal salt is selected from the group consisting of zinc, calcium, magnesium, barium, sodium, and lithium.

18. The golf ball of claim 1, wherein the core has a compression of about 75 or less and the golf ball has a coefficient of restitution of about 0.800 or greater.

19. The golf ball of claim 18, wherein the coefficient of restitution of about 0.815 or greater.

20. The golf ball of claim 1, wherein the core has a compression about 55 or less and to golf ball has a coefficient of restitution of about 0.800 or greater.

21. The golf ball of claim 1, wherein the diene rubber comprises an α,β-unsaturated carboxylic acid or a metal salt thereof an organic peroxide, and at least one density adjusting filler.

22. The golf ball of claim 1, wherein the polymer composition comprises at least one of a UV absorber, a hindered amine light stabilizer, or an optical brightener or at least one density adjusting filler.

* * * * *